US010035255B2

(12) United States Patent
Cindric et al.

(10) Patent No.: US 10,035,255 B2
(45) Date of Patent: Jul. 31, 2018

(54) PORTABLE WORKBENCH ASSEMBLY

(71) Applicants: Owen Cindric, Slickville, PA (US); Brett White, Slickville, PA (US)

(72) Inventors: Owen Cindric, Slickville, PA (US); Brett White, Slickville, PA (US)

( * ) Notice: Subject to any disclaimer, the term of this patent is extended or adjusted under 35 U.S.C. 154(b) by 0 days.

(21) Appl. No.: 15/278,282

(22) Filed: Sep. 28, 2016

(65) Prior Publication Data

US 2018/0085912 A1 Mar. 29, 2018

(51) Int. Cl.

| | |
|---|---|
| ***B25H 1/04*** | (2006.01) |
| ***A47B 3/08*** | (2006.01) |
| ***E06C 1/39*** | (2006.01) |
| ***E04G 1/30*** | (2006.01) |
| ***E04G 5/10*** | (2006.01) |

(52) U.S. Cl.

CPC ..... *B25H 1/04* (2013.01); *A47B 3/08* (2013.01); *E04G 1/30* (2013.01); *E04G 5/10* (2013.01); *E06C 1/39* (2013.01); *A47B 2220/05* (2013.01)

(58) Field of Classification Search

CPC ..... A47B 3/08; A47B 3/091; A47B 3/0815; A47B 3/0809

USPC ..... 108/127, 129, 130, 131, 132, 133; 182/152, 153, 155

See application file for complete search history.

(56) References Cited

U.S. PATENT DOCUMENTS

| | | | | |
|---|---|---|---|---|
| 310,245 | A * | 1/1885 | Benedict | A47B 3/0815 108/133 |
| 329,903 | A | 11/1885 | Hogeland | |
| 337,988 | A * | 3/1886 | Palmer | E04G 1/30 108/50.11 |
| 3,099,428 | A * | 7/1963 | Heyer | A47B 3/0818 108/129 |
| 3,271,075 | A * | 9/1966 | Good | A47C 16/02 108/129 |
| 3,805,711 | A * | 4/1974 | Lakso | A47B 23/001 108/133 |
| 3,857,343 | A * | 12/1974 | Greenberg | A47B 23/001 108/132 |
| 4,144,822 | A * | 3/1979 | Roberts | A47B 3/0815 108/125 |
| 4,191,113 | A | 3/1980 | Hogberg | |
| 4,383,488 | A * | 5/1983 | Macho | A47B 3/08 108/129 |
| 4,462,636 | A * | 7/1984 | Markson | A47C 16/02 108/128 |
| 4,951,781 | A * | 8/1990 | Bliss | E04G 1/34 108/115 |
| D367,967 | S | 3/1996 | Caleise et al. | |
| 5,518,084 | A | 5/1996 | Short et al. | |
| 5,697,669 | A | 12/1997 | Yemini | |
| 5,882,097 | A | 3/1999 | Kohagen et al. | |

(Continued)

FOREIGN PATENT DOCUMENTS

| | | |
|---|---|---|
| EP | 0074896 | 9/1982 |

*Primary Examiner* — Jose V Chen

(57) ABSTRACT

A portable workbench assembly includes a table. Objects may be positioned on the table thereby facilitating the objects to be accessible. A handle is hingedly coupled to the table thereby facilitating the table to be carried. A pair of stands is provided and each of the stands is hingedly coupled to the table. Each of the stands is selectively positioned in a deployed position to abut a support surface. Each of the stands is selectively positioned in a stored position.

10 Claims, 4 Drawing Sheets

(56) References Cited

U.S. PATENT DOCUMENTS

| | | | | | |
|---|---|---|---|---|---|
| 5,967,259 | A * | 10/1999 | Williams | E06C 7/14 | 182/129 |
| D486,243 | S * | 2/2004 | Yamaoka | D25/62 | |
| 6,892,860 | B2 * | 5/2005 | Gibson | E04G 1/28 | 108/119 |
| 7,147,083 | B1 * | 12/2006 | Colgrove | B25H 1/06 | 182/153 |
| 8,042,653 | B2 * | 10/2011 | Grebinoski | E04G 1/15 | 182/223 |
| 8,113,316 | B2 * | 2/2012 | Sward | G01N 33/497 | 108/62 |
| 8,465,100 | B2 * | 6/2013 | Kim | A47C 16/025 | 297/423.41 |
| 9,357,842 | B2 * | 6/2016 | Gu | A47B 85/06 | |
| 9,422,768 | B2 * | 8/2016 | Yoo | E06C 1/393 | |
| 9,752,334 | B2 * | 9/2017 | Foley | E04G 1/34 | |
| 2002/0178978 | A1 * | 12/2002 | Wang | B25H 1/04 | 108/133 |
| 2003/0177961 | A1 * | 9/2003 | Wang | A47B 3/0818 | 108/126 |
| 2009/0078165 | A1 * | 3/2009 | Tseng | A47B 3/0912 | 108/6 |
| 2009/0199746 | A1 * | 8/2009 | Horton | A47B 3/00 | 108/129 |
| 2009/0294214 | A1 | 12/2009 | Vosbikian et al. | | |
| 2010/0071996 | A1 * | 3/2010 | Huang | E04G 1/34 | 182/118 |

* cited by examiner

PORTABLE WORKBENCH ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to workbench devices and more particularly pertains to a new workbench device for supporting tools in a work area.

BRIEF SUMMARY OF THE INVENTION

An embodiment of the disclosure meets the needs presented above by generally comprising a table. Objects may be positioned on the table thereby facilitating the objects to be accessible. A handle is hingedly coupled to the table thereby facilitating the table to be carried. A pair of stands is provided and each of the stands is hingedly coupled to the table. Each of the stands is selectively positioned in a deployed position to abut a support surface. Each of the stands is selectively positioned in a stored position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
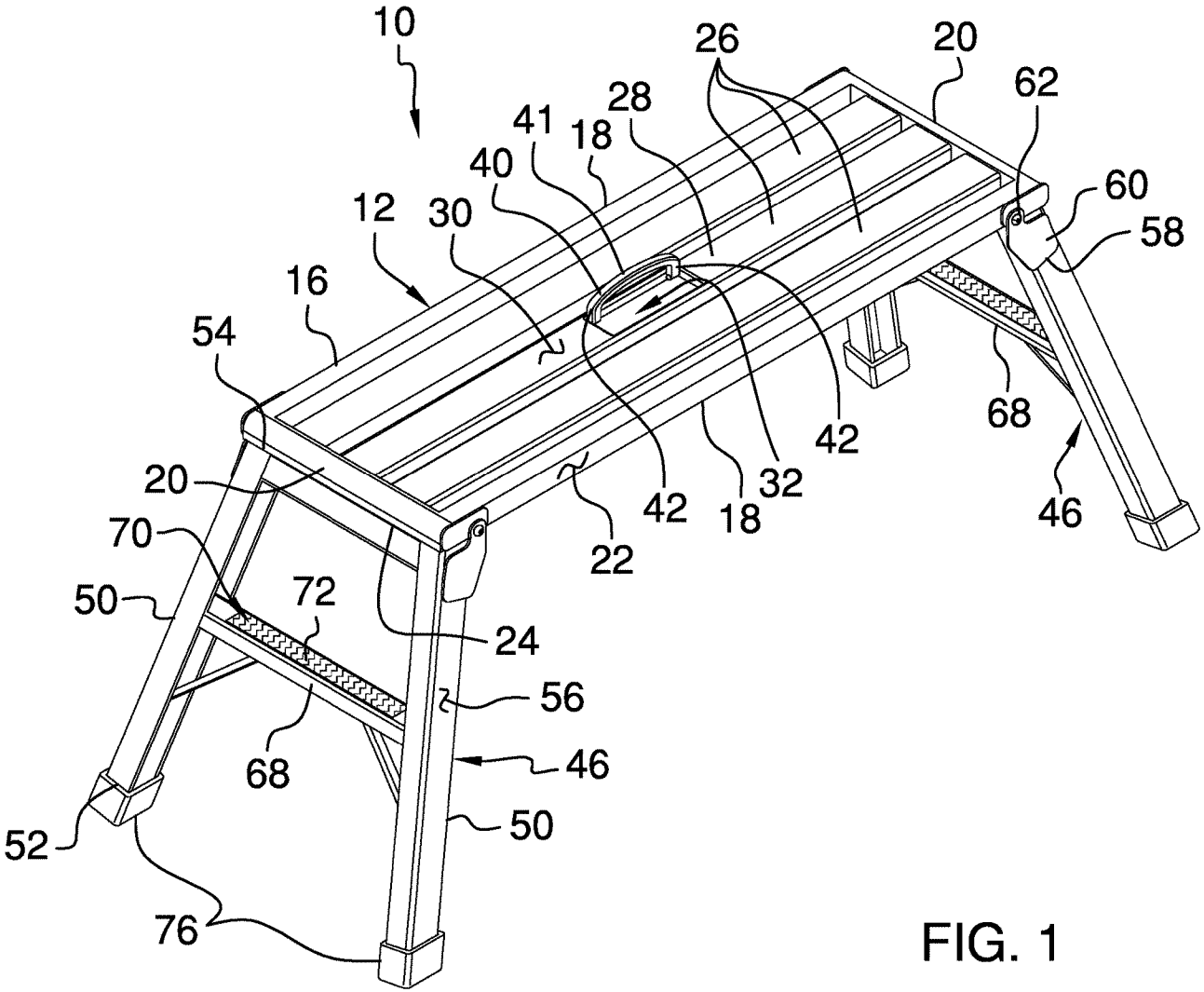
FIG. 1 is a perspective view of a portable workbench assembly according to an embodiment of the disclosure.
Figure 2:
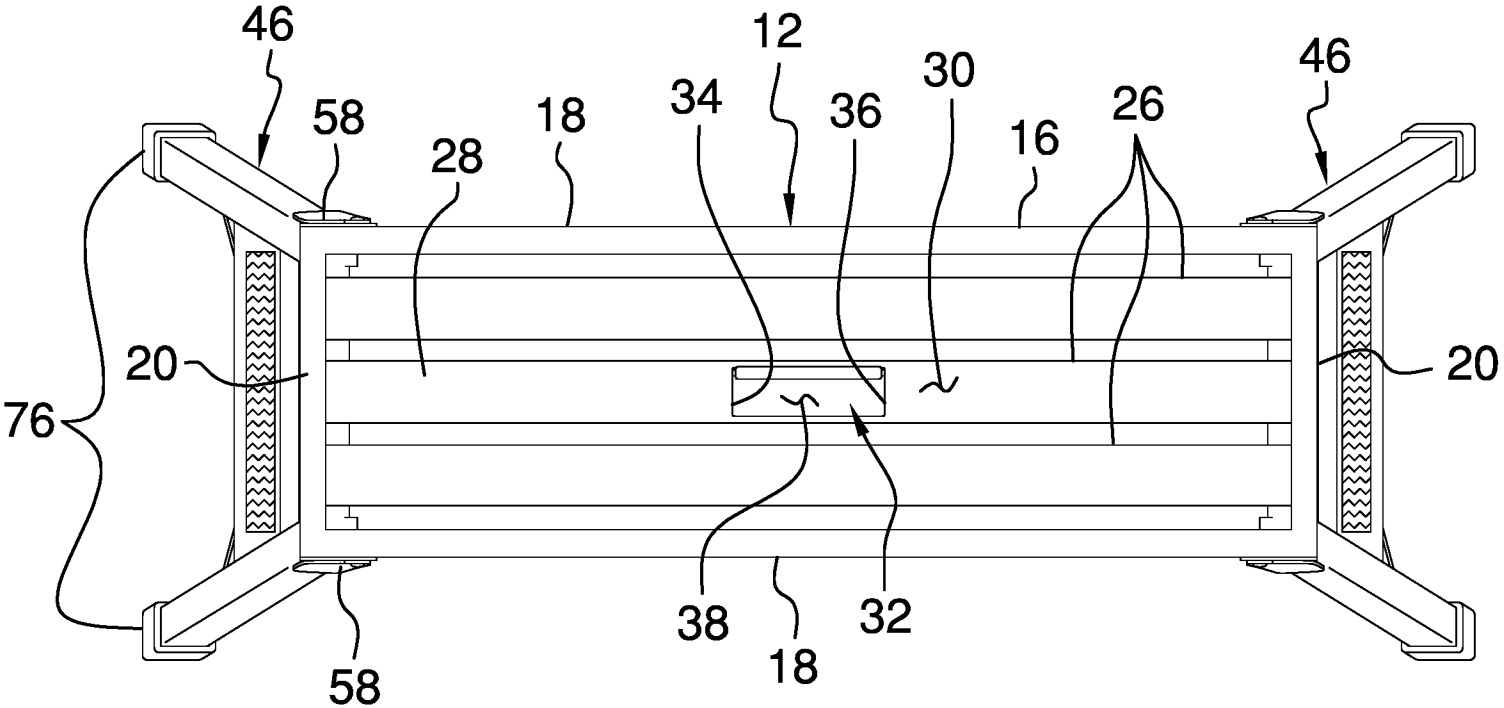
FIG. 2 is a top view of an embodiment of the disclosure.
Figure 3:
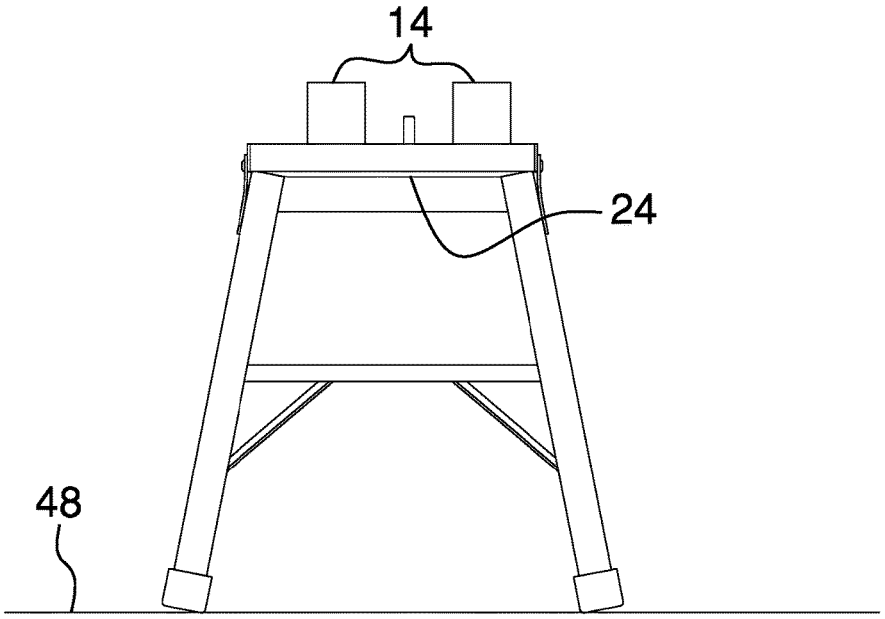
FIG. 3 is a right side view of an embodiment of the disclosure.
Figure 4:
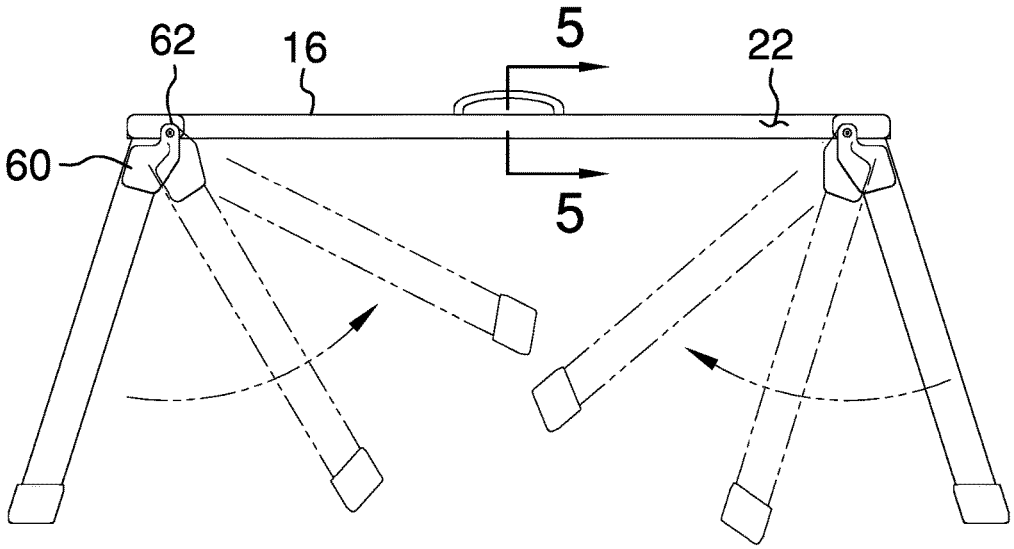
FIG. 4 is a front view of an embodiment of the disclosure.
Figure 5:
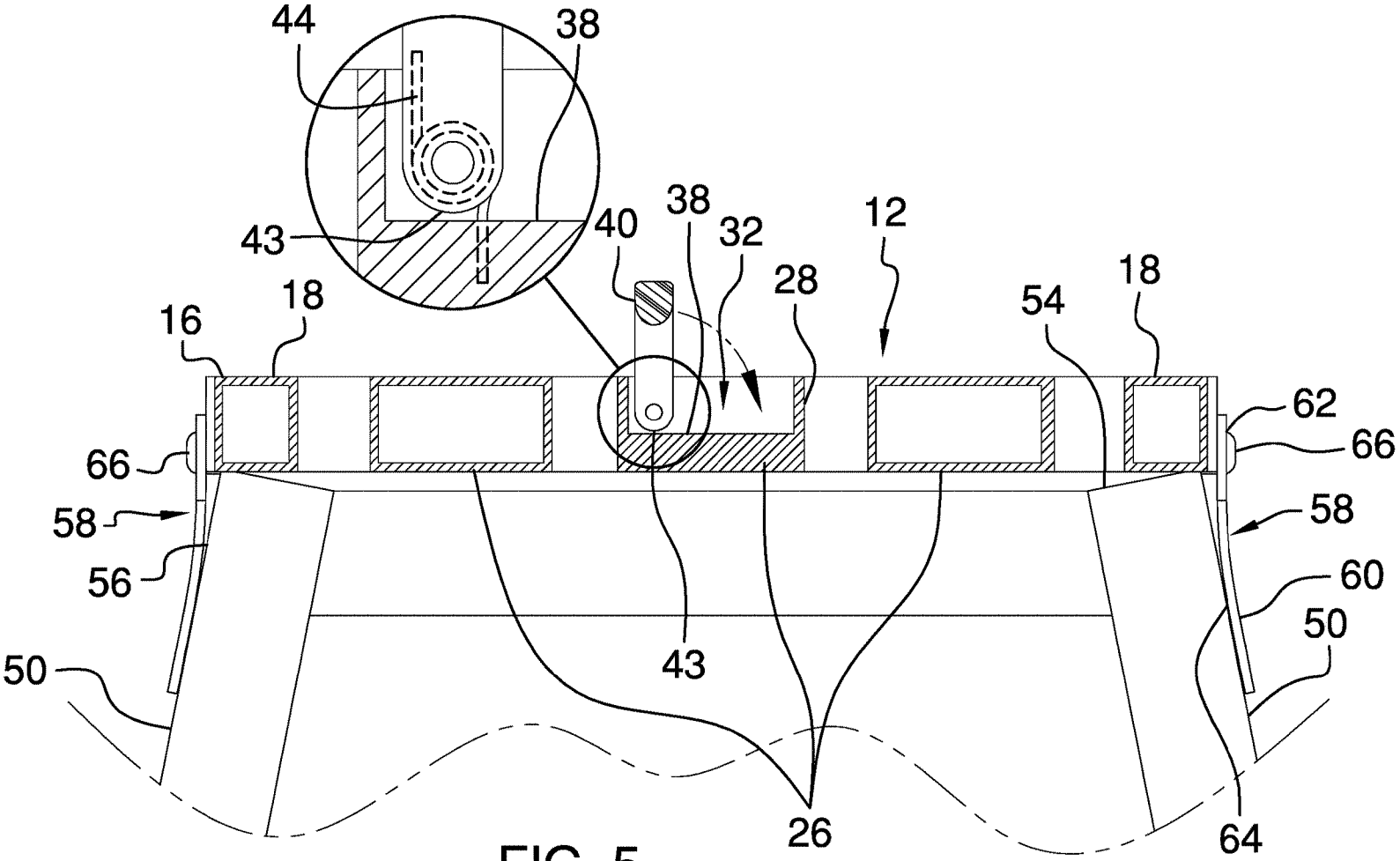
FIG. 5 is a cross sectional view taken along line 5-5 of FIG. 4 of an embodiment of the disclosure.

With reference now to the drawings, and in particular to FIGS. 1 through 5 thereof, a new workbench device embodying the principles and concepts of an embodiment of the disclosure and generally designated by the reference numeral 10 will be described.

As best illustrated in FIGS. 1 through 5, the portable workbench assembly 10 generally comprises a table 12. Objects 14 may be positioned on the table 12. Thus, the objects 14 are accessible. The objects 14 may be tools or the like.

The table 12 comprises a frame 16 that has a pair of first members 18 extending between a pair of second members 20. The first members 18 are spaced apart from each other such that the frame 16 has a rectangular shape. Each of the first members 18 has an outwardly facing surface 22. Each of the second members 20 has a downwardly facing surface 24.

A plurality of third members 26 is provided. Each of the third members 26 is coupled to and extends between each of the second members 20. The third members 26 are spaced apart from each other. The plurality of third members 26 includes a middle member 28.

The middle member 28 has a top surface 30. The top surface 30 has a well 32 extending downwardly therein. The well 32 has a first lateral bounding surface 34, a second lateral bounding surface 36, and a bottom bounding surface 38. The well 32 is centrally positioned on the middle member 28.

A handle 40 is provided and the handle 40 is hingedly coupled to the table 12. The handle 40 may be gripped thereby facilitating the table 12 to be carried. The handle 40 has a central portion 41 extending between a pair of end portions 42. Each of the end portions 42 has a distal end 43 with respect to the central portion 41. The distal end 43 corresponding to each of the end portions 42 is hingedly coupled to an associated one of the first lateral bounding surface 34 and an associated one of the second lateral bounding surface 36.

The handle 40 is positioned in a deployed position. Thus, the handle 40 extends upwardly from the well 32 and the central portion 41 may be gripped. The handle 40 is positioned in a stored position. Thus, the handle 40 is positioned within the well 32.

A biasing member 44 is coupled to the handle 40. The biasing member 44 engages the bottom bounding surface 38 of the well 32. Thus, the biasing member 44 biases the handle 40 into the stored position. The biasing member 44 may be a pigtail spring or the like.

A pair of stands 46 is provided. Each of the stands 46 is hingedly coupled to the table 12. Each of the stands 46 is selectively positioned in a deployed position. Thus, each of the stands 46 abuts a support surface 48 thereby facilitating the table 12 to be spaced from the support surface 48. The support surface 48 may be ground or the like. Each of the stands 46 is selectively positioned in a stored position.

Each of the stands 46 comprises a pair of legs 50. Each of the legs 50 has a first end 52, a second end 54 and an outwardly facing surface 56 extending between the first end 52 and the second end 54. Each of the legs 50 extends downwardly from the table 12 when the stands 46 are positioned in the deployed position. Moreover, each of the legs 50 is substantially coextensive with the table 12 when the stands 46 are positioned in the stored position.

A pair of hinges 58 is provided. Each of the hinges 58 comprises a plate 60 and a lobe 62 extending away from the plate 60. The plate 60 corresponding to each of the hinges 58 has a first surface 64. The first surface 64 corresponding to each of the hinges 58 is coupled to the outwardly facing surface 22 of an associated one of the legs 50. The lobe 62 corresponding to each of the hinges 58 extends upwardly from the second end 54 of the associated leg 50.

A pair of pins 66 is provided. Each of the pins 66 extends through the lobe 62 of an associated one of the hinges 58. Moreover, each of the pins 66 engages the outwardly facing surface 22 of an associated one of the first members 18. The second end 54 of each of the legs 50 abuts the downwardly facing surface 24 of an associated one of the second members 20 when the stands 46 are positioned in the deployed position. Thus, each of the legs 50 is retained in a substantially vertical orientation when the stands 46 are positioned in the deployed position.

A step 68 is coupled between each of the legs 50 and the step 68 may be stood upon. The step 68 is centrally positioned between the first end 52 and the second end 54 of each of the legs 50. The step 68 has an upwardly facing surface 70. A strip 72 is coupled to the upwardly facing surface 70 of the step 68. The strip 72 is comprised of a textured material. Thus, the strip 72 enhances gripping the step 68 when the step 68 is stood upon.

A pair of gussets 74 is provided. Each of the gussets 74 is coupled between the step 68 and an associated one of the legs 50. Thus, each of the gussets 74 enhances a load bearing capacity of the step 68. A pair of cups 76 is provided. Each of the cups 76 insertably receives the second end 54 of an associated one of the legs 50. Thus, each of the cups 76 frictionally engages the support surface 48 when the stands 46 are positioned in the deployed position.

In use, each of the stands 46 is manipulated into the deployed position. Thus, the table 12 is spaced from the support surface 48. The objects 14 are placed on the table 12 thereby facilitating the objects 14 to be accessible. The handle 40 is manipulated into the deployed position and the central portion 41 is gripped. Thus, the table 12 is movable with one hand thereby facilitating the table 12 to be moved without setting down tools or the like.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A portable workbench assembly having a centrally positioned handle wherein said assembly is configured to be carried, said assembly comprising:

a table being configured to have objects positioned thereon thereby facilitating the objects to be accessible, said table including a frame having a pair of first members extending between a pair of second members, said first members being spaced apart from each other such that said frame has a rectangular shape, each of said first members having an outwardly facing surface, each of said second members having a downwardly facing surface, said table including a plurality of third members, each of said third members being coupled to and extending between each of said second members, said third members being spaced apart from each other, said plurality of third members including a middle member, said middle member having a top surface, said top surface having a well extending downwardly therein, said well having a first lateral bounding surface, a second lateral bounding surface, and a bottom bounding surface;

a handle being hingedly coupled to said table wherein said handle is configured to be gripped thereby facilitating said table to be carried, said handle having a central portion extending between a pair of end portions, each of said end portions having a distal end with respect to said central portion, said distal end corresponding to each of said end portions being hingedly coupled to an associated one of said first lateral bounding surface and an associated one of said second lateral bounding surface, said handle being positioned in a deployed position having said handle extending upwardly from said well wherein said central portion is configured to be gripped, said handle being positioned in a stored position having said handle being positioned within said well; and a pair of stands, each of said stands being hingedly coupled to said table, each of said stands being selectively positioned in a deployed position wherein each of said stands is configured to abut a support surface thereby facilitating said table to be spaced from the support surface, each of said stands being selectively positioned in a stored position.

2. The assembly according to claim 1, wherein each of said stands comprises a pair of legs, each of said legs having a first end, a second end and an outwardly facing surface extending between said first end and said second end.

3. The assembly according to claim 1, further comprising:

a pair of legs, each of said legs having an outwardly facing surface and a second end; and a pair of hinges, each of said hinges comprising a plate and a lobe extending away from said plate, said plate corresponding to each of said hinges having a first surface.

4. The assembly according to claim 3, wherein said first surface corresponding to each of said hinges being coupled to said outwardly facing surface of an associated one of said legs having said lobe corresponding to each of said hinges extending upwardly from said second end of said associated leg.

5. The assembly according to claim 4, further comprising:

a pair of first members, each of said first members having an outwardly facing surface;

a pair of second members, each of said second members having a downwardly facing surface; and a pair of pins, each of said pins extending through said lobe of an associated one of said hinges and engaging said outwardly facing surface of an associated one of said first members, said second end of each of said legs abutting said downwardly facing surface of an associated one of said second members when said stands are positioned in said deployed position.

6. The assembly according to claim 1, further comprising:

a pair of legs, each of said legs having a first end and a second end; and a step being coupled between each of said legs wherein said step is configured to be stood upon, said step being centrally positioned between said first end and said second end of each of said legs, said step having an upwardly facing surface.

7. The assembly according to claim 6, further comprising a strip being coupled to said upwardly facing surface of said step wherein said strip is configured to enhance gripping said step when said step is stood upon.

8. The assembly according to claim 6, further comprising a pair of gussets, each of said gussets being coupled between said step and an associated one of said legs wherein each of said gussets is configured to enhance a load bearing capacity of said step.

9. The assembly according to claim 6, further comprising a pair of cups, each of said cups insertably receiving said second end of an associated one of said legs wherein each of said cups is configured to frictionally engage the support surface when said stands are positioned in said deployed position.

10. A portable workbench assembly having a centrally positioned handle wherein said assembly is configured to be carried, said assembly comprising:

a table being configured to have objects positioned thereon thereby facilitating the objects to be accessible, said table comprising:

a frame having a pair of first members extending between a pair of second members, said first members being spaced apart from each other such that said frame has a rectangular shape, each of said first members having an outwardly facing surface, each of said second members having a downwardly facing surface, a plurality of third members, each of said third members being coupled to and extending between each of said second members, said third members being spaced apart from each other, said plurality of third members including a middle member, said middle member having a top surface, said top surface having a well extending downwardly therein, said well having a first lateral bounding surface, a second lateral bounding surface, and a bottom bounding surface, a handle being hingedly coupled to said table wherein said handle is configured to be gripped thereby facilitating said table to be carried, said handle having a central portion extending between a pair of end portions, each of said end portions having a distal end with respect to said central portion, said distal end corresponding to each of said end portions being hingedly coupled to an associated one of said first lateral bounding surface and an associated one of said second lateral bounding surface, said handle being positioned in a deployed position having said handle extending upwardly from said well wherein said central portion is configured to be gripped, said handle being positioned in a stored position having said handle being positioned within said well;

a biasing member being coupled to said handle, said biasing member engaging said bottom bounding surface of said well such that said biasing member biases said handle into said stored position; and a pair of stands, each of said stands being hingedly coupled to said table, each of said stands being selectively positioned in a deployed position wherein each of said stands is configured to abut a support surface thereby facilitating said table to be spaced from the support surface, each of said stands being selectively positioned in a stored position, each of said stands comprising:

a pair of legs, each of said legs having a first end, a second end and an outwardly facing surface extending between said first end and said second end, a pair of hinges, each of said hinges comprising a plate and a lobe extending away from said plate, said plate corresponding to each of said hinges having a first surface, said first surface corresponding to each of said hinges being coupled to said outwardly facing surface of an associated one of said legs having said lobe corresponding to each of said hinges extending upwardly from said second end of said associated leg, a pair of pins, each of said pins extending through said lobe of an associated one of said hinges and engaging said outwardly facing surface of an associated one of said first members, said second end of each of said legs abutting said downwardly facing surface of an associated one of said second members when said stands are positioned in said deployed position, a step being coupled between each of said legs wherein said step is configured to be stood upon, said step being centrally positioned between said first end and said second end of each of said legs, said step having an upwardly facing surface, a strip being coupled to said upwardly facing surface of said step wherein said strip is configured to enhance gripping said step when said step is stood upon, a pair of gussets, each of said gussets being coupled between said step and an associated one of said legs wherein each of said gussets is configured to enhance a load bearing capacity of said step, and a pair of cups, each of said cups insertably receiving said second end of an associated one of said legs wherein each of said cups is configured to frictionally engage the support surface when said stands are positioned in said deployed position.

* * * * *